United States Patent [19]

Jalasjaa

[11] 4,034,527

[45] July 12, 1977

[54] LOG CABIN CONSTRUCTION

[76] Inventor: Bert (Pertti) Olavi Jalasjaa, 519 Weber St. N., Waterloo, Ontario, Canada

[21] Appl. No.: 667,198

[22] Filed: Mar. 15, 1976

[51] Int. Cl.[2] ..... E04B 1/00; E04C 1/10

[52] U.S. Cl. ..... 52/233; 52/586; 52/593; 52/79.1

[58] Field of Search ..... 52/233, 241, 285, 286, 52/586, 588, 593; 46/20, 25, 26

[56] References Cited

U.S. PATENT DOCUMENTS

| | | | |
|---|---|---|---|
| 1,910,326 | 5/1933 | Ford | 52/593 |
| 1,942,348 | 1/1934 | Ward | 52/593 |
| 2,291,712 | 8/1942 | Hatton | 52/586 |
| 2,321,120 | 6/1943 | Baker | 52/233 |
| 3,189,950 | 6/1965 | Johnson | 52/233 |
| 3,197,933 | 8/1965 | Burns et al. | 52/586 |
| 3,363,386 | 1/1968 | Elflein et al. | 52/586 |
| 3,381,428 | 5/1968 | Sillman | 52/233 |
| 3,818,653 | 6/1974 | Williams | 52/233 |
| 3,849,960 | 11/1974 | Henry et al. | 52/233 |

*Primary Examiner*—Price C. Faw, Jr.
*Assistant Examiner*—Robert C. Farber
*Attorney, Agent, or Firm*—George A. Rolston

[57] ABSTRACT

A log cabin type structure formed of horizontally arranged "log" type tongued and grooved planks having notched ends which are arranged to overlap and interfit with one another to form corners, and having holes drilled through such overlapping portions for reception of a vertical metal tie rod. In accordance with a feature of the invention, the holes are preferably slightly oversize with regard to the metal tie rod, thereby facilitating assembling of the structure. The holes in alternate logs will however be slightly misaligned with one another, such misalignment being produced in one of various different ways. As the logs are bedded down with one another, the misalignment of the holes causes the holes to bind tightly on the rod and thereby procures pressure on the log ends causing them to be drawn firmly into engagement with one another in the corners. Sealing surfaces formed transversely of the log ends are thus forced into pressurized mutually sealing engagement. End fasteners at the top and bottom of the metal tie rods provide vertical pressure preventing the disassembly of the corners, and also securing the logs with their tongues and grooves in sealing engagement.

6 Claims, 11 Drawing Figures

FIG 1

LOG CABIN CONSTRUCTION

The invention relates to a log cabin type structure typically being used for sauna construction, although not exclusively confined thereto.

BACKGROUND OF THE INVENTION

Log cabin type structures are typically small rectangular rooms formed of horizontally laid relatively thick planks or so called "logs" which may be 1¼to 3 inches thick. The use of the relatively thick wood provides a high degree of thermal insulation, and also provides an attractive appearance both inside and out without the requirement for additional wall finishings.

This type of structure is typically used for domestic saunas. This type of construction may also be used however for outdoor structures such as vacation cottages and chalets, and garden structures such as swimming pool changing huts and the like.

It is prime feature of this type of construction, that it can be readily erected by a householder with only common hand tools. In addition, at least when a sauna is constructed in a home for example the structure must be erected in a relatively confined space.

"Log" structures such as these are found to exhibit some expansion and contraction or warping of individual planks or "logs" and it is essential that the corners of the structure be held together by a strong and yet simple fastening system. If this is not done, then the logs will tend to loosen, or become unsealed. This is particularly undesirable in the case of a sauna where the interior of the structure is subjected to high temperatures, and to a high humidity. If the vapor escapes into the home, it may cause mildew and rot in other parts of the home and is highly unsatisfactory.

Similarly, when such structures are used for any outdoor construction, it is obviously desirable that the logs should remain held tightly together so that they will provide a good hermetically sealed wall.

In the past, various proposals have been made to overcome this problem. For example, one popular system employs logs which are notched at their corners, and overlap one above the other. A series of wooden pegs pass through grooves formed in the corner portions of the logs. Such a system is extremely complex, and in particular, the grooves must be machined with a high degree of accuracy so that they will line up once the logs are arranged, since otherwise the wooden pegs cannot be inserted. In practice, it is almost impossible to obtain the necessary high degree of manufacturing tolerance, when machining the logs. In addition, even though the logs are securely pegged together, they can still move somewhat upwardly and downwardly causing them to be gradually loosened.

Another system has been proposed in which some form of exterior fastening is arranged around the outside of the corners of the structure.

At first sight it would appear that the simplest way of solving the problem is simply to run a lengthwise metal rod up through overlapping corners of the logs with fastenings at the top and bottom of the rod. This will apply vertical pressure to the overlapping notched corners of the logs and hold them together. However, such a system does nothing to prevent slight endwise movement of the logs. It does not therefore provide a satisfactory solution.

In addition to all of these problems, it is essential that a good vapor tight seal should be provided at the corners of the logs. The logs are provided with conventional lengthwise interlocking tongues and grooves which provide as far as possible a good vapour tight seal provided they are securely fastened. However, at the corners, the sealing of the overlapping interlocking portions of the logs presents a more difficult problem. Unless accurately machined mating surfaces are provided in the corners, and unless such surfaces are held together by constant pressure, the logs will tend, as a result of expansion and contraction, to work loose thereby opening up the corners.

BRIEF SUMMARY OF THE INVENTION

The invention therefore seeks to provide a log cabin type structure formed of horizontally arranged "log" type planks having notched ends which are arranged to overlap and interfit with one another to form corners, and having holes drilled through such overlapping end portions for reception of a vertical metal tie rod. In accordance with the invention, the holes will be slightly over size with regard to the metal tie rod, thereby facilitating assembling of the structure. The holes in alternate logs will however be slightly misaligned with one another, such misalignment being produced in one of various different ways. As the logs are bedded down with one another, the misalignment of the holes causes the holes to bind tightly on the rod and thereby procures endwise pressure on the log ends causing them to be drawn firmly into engagement with one another in the corners. End fasteners at the top and bottom of the metal tie rods provide vertical pressure preventing the disassembly of the corners, and also securing the logs with their tongues and grooves in sealing engagement.

Interlocking mating surfaces are machined at the corners of the logs, these mating surfaces abutting with one another, and being drawn together by the longitudinal endwise pressure resulting from the metal tie rods and the misalignment of the holes, thereby providing a good vapor tight corner seal.

In accordance with one form of the invention, the misalignment of the holes in the overlapping corner portions of the logs results from the location of the interlocking mating sealing surfaces, the location of such surfaces determining the location of the hole for the tie rod in a log, relative to the next adjacent log.

In accordance with an alternate feature of the invention the misalignment of the holes is produced by simply drilling the holes slightly offset with regard to one another in alternate overlapping log corner portions.

Preferably, in accordance with the invention, the mating sealing surfaces at each corner are provided by a right angular shoulder formed on the end of one log, and a right angular recess formed on the end of the adjacent log.

Preferably the overlapping log portions forming the corners will be arranged so as to ensure that the logs are assembled in alternate courses around the structure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF A SPECIFIC EMBODIMENT

Figure 1:
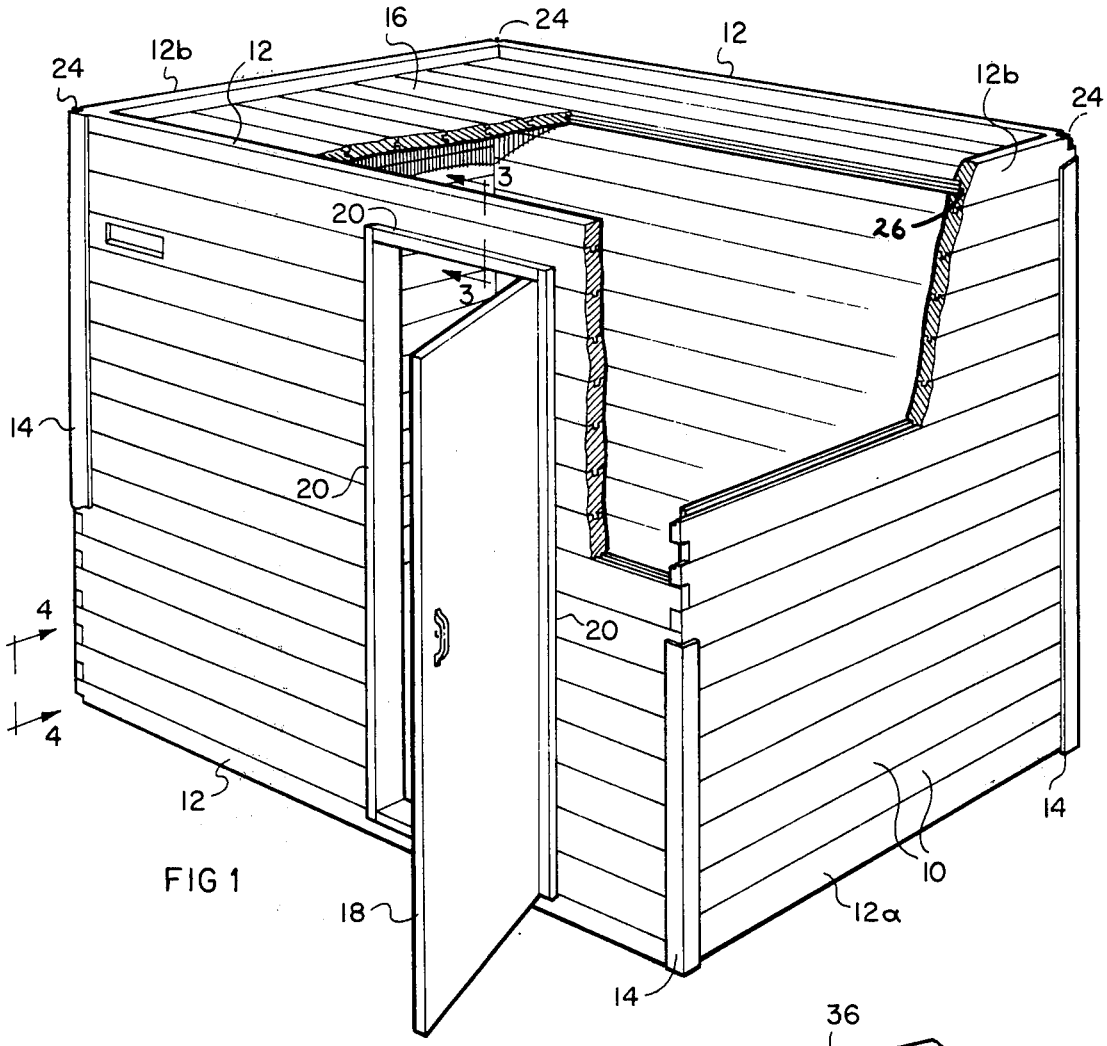
FIG. 1 is a perspective illustration of a typical log cabin type structure partially cut away to reveal its construction.

As shown generally in FIG. 1, the invention is illustrated here in conjunction with a typical log cabin type structure, in this case a sauna room consisting essentially of four walls and a roof. As is shown, the walls are made up of horizontally laid log type planks 10 laid edgewise one on top of the other. Typically such planks will be 1¼to 3 inches thick so as to provide effective thermal insulation, and will not normally require any additional exterior or interior finishing.

The logs are notched at their corners so that they may interfit with one another. However, the courses of the logs on any two adjacent sides will be seen to be offset with respect to one another by the width of one half a log. Thus in two of the four walls, half logs 12 will be required at the top and bottom for starting and finishing. On the other two walls, such starting and finishing logs 12*a* and 12*b* will be of full width. However, the starting logs 12*a* will have their tongues removed.

An exterior finish may be provided on the four corners as is shown for example by the L-shaped wooden trim member 14.

The roof or ceiling is provided by a horizontal system of logs 16 arranged edge to edge to be described in more detail herein.

A door 18 is mounted in a suitable door frame 20. The door frame 20 is of any suitable known construction, and has a suitable groove or recess not shown for receiving the planks 10. Preferably there will be some space within such a door frame 20 so that the planks 10 may move somewhat in relation to the door as they expand and contract in use.

The interior of the structure may of course be fitted out with seats, benches, heaters, showers, and the like all of which are well known in the art and form no part of the present invention.

The four corners of the structure are secured and held together by vertical metal tie rods 24. The tie rods are provided with suitable fastenings such as nuts or the like and any suitable washers both at their upper and lower ends, although the precise details of such fastenings are irrelevant for the purposes of the present invention, and any of a variety of different types of fastenings would be equally effective.

Figure 3B:
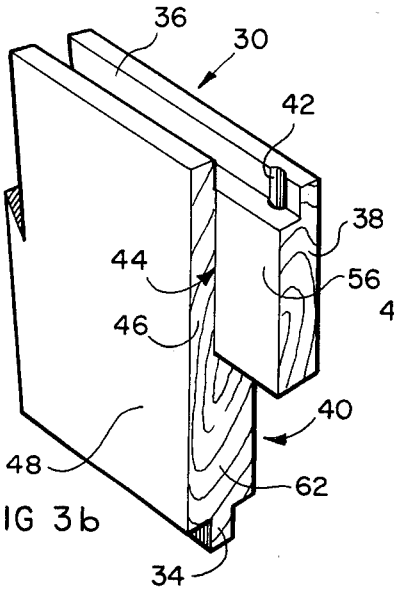
FIGS. 3*a* and 3*b* are perspectives of respective right and left hand log ends.
Figure 3A:
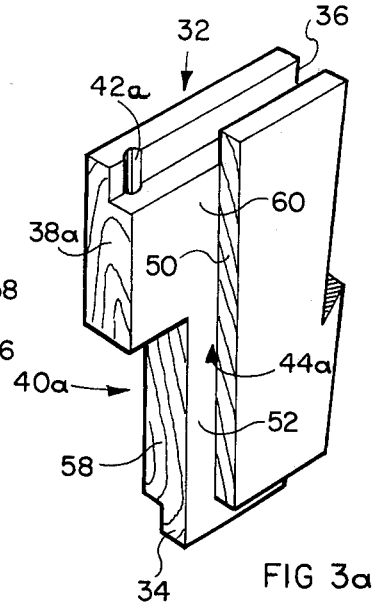
Figure 5:
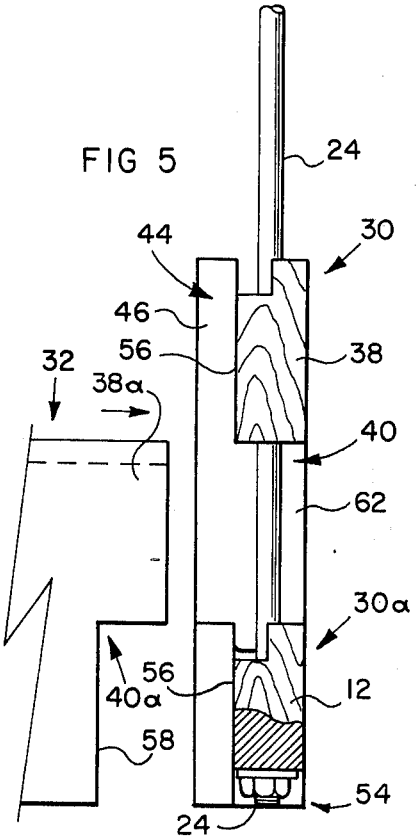
FIG. 5 is an exploded side elevational view of the detail of FIG. 4, seen from the arrows 5—5 of FIG. 4.
Figure 4:
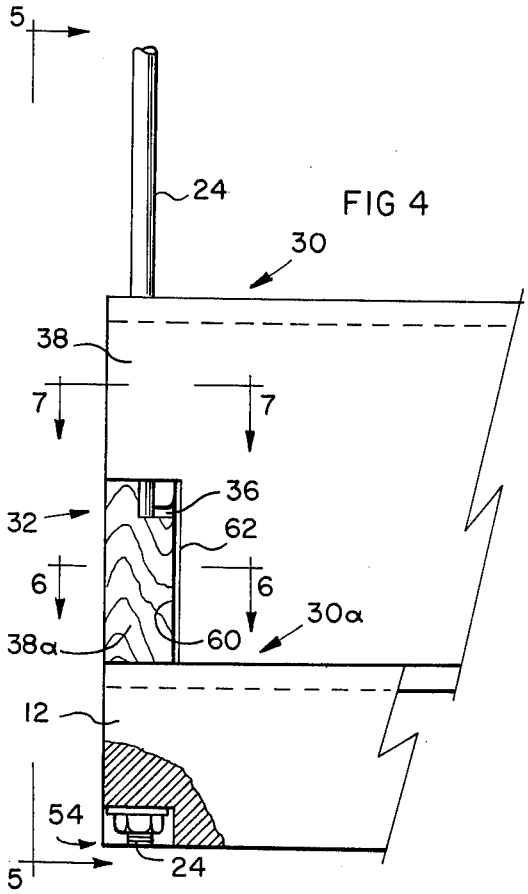
FIG. 4 is a side elevational portion of a detail of FIG. 1 showing a corner from one direction.

As shown in FIG. 3, the roof logs 16 will preferably be received in a groove 26 formed in the top most logs 12 or 12*b* around the interior of the four walls of the structure as shown.

Figure 2:
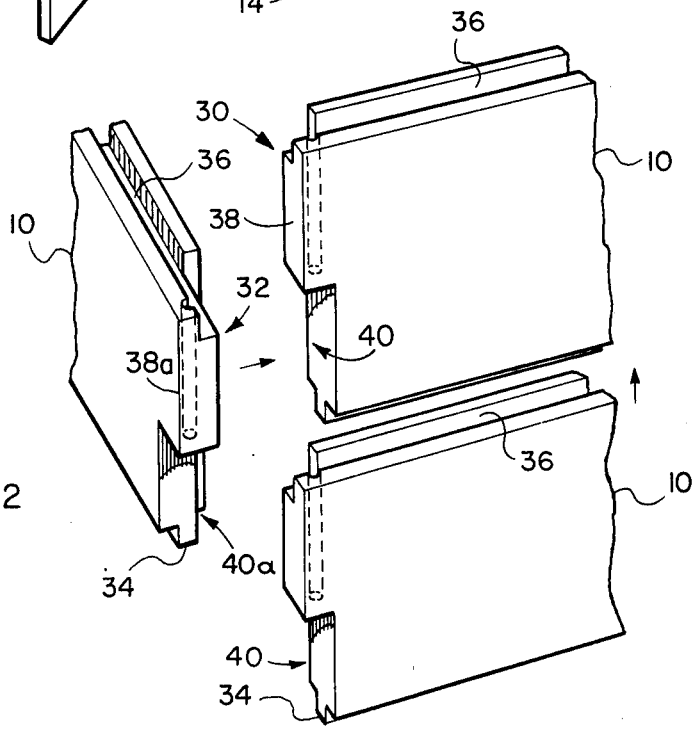
FIG. 2 is an enlarged exploded perspective view of adjacent corner portions of two adjacent logs.

Referring now to FIGS. 2 and 4 through 9, the corner construction in accordance with the invention will be seen to comprise right and left hand ends on each log 10 or 12, 12*a* or 12*b* which are formed in a complementary mating fashion, but which are not identical with one another. Referring first of all to FIG. 2, what may be designated as the right hand log end is shown in general as 30 and the left hand log end is shown as 32. It will be understood that each log 10 is formed at one end with the log end 30 and at the other end with the log end 32. Each log 10 is of course provided with longitudinal lower tongues 34 and upper grooves 36.

As shown, both log end 30 and log end 32 will be seen to comprise respective corner-forming overlapping block portions 38 and 38*a* and lower notch portions indicated generally as 40 and 40*a*. It will of course be understood that the block portion 38 is designed to fit within the notch portion 40*a*, and the block portion 38*a* will fit in the notch portion 40 of an adjacent upper log 10.

Figure 6:
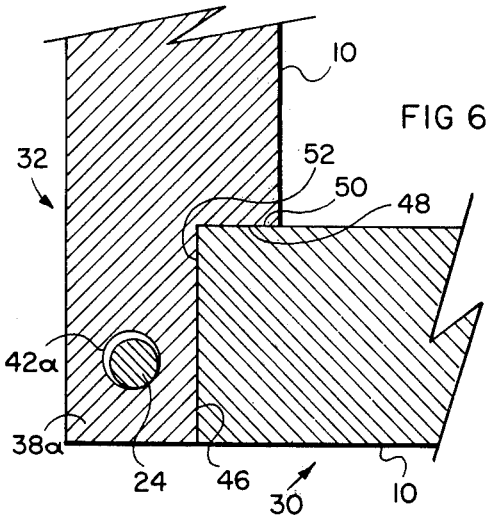
FIG. 6 is a section along the line 6—6 of FIG. 4.
Figure 7:
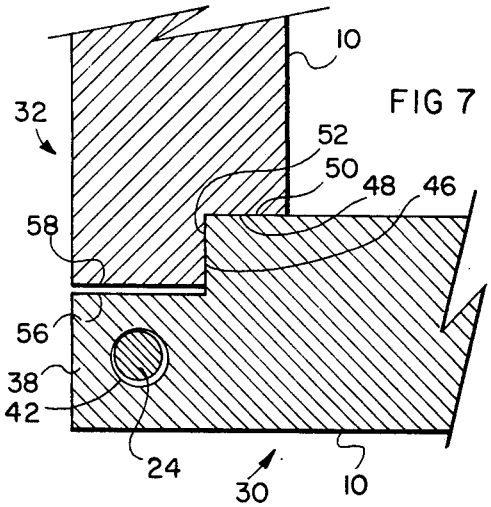
FIG. 7 is a section along the line 7—7 of FIG. 4.
Figure 8:
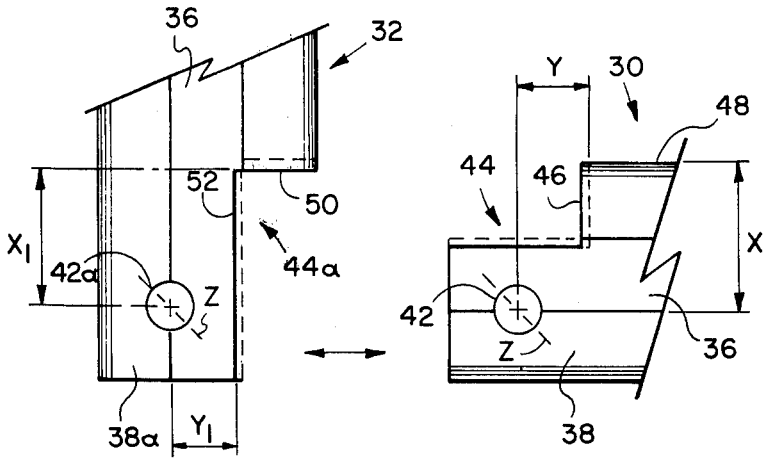
FIG. 8 is a top plan view of the two log corner portions as shown in FIG. 2.

Each of the block portions 38 and 38*a* is provided with respective vertical holes 42 and 42*a*. In the case of the embodiments shown in FIGS. 6, 7 and 8, the holes 42 and 42*a* are drilled in the same location on each of the blocks 38 and 38*a*. As shown in FIG. 8, such holes 42 and 42*a* respectively are drilled essentially in the center of the rectangular block portion 38 or 38*a*. However it will be appreciated that such a central location is merely for the sake of convenience. Such holes could equally well be drilled in some off center location. As shown in FIGS. 6 and 7, such holes 42 and 42*a* are slightly oversize with respect to the diameter of the metal tie rod 24. This relationship will be discussed in greater detail in relation to FIG. 9.

In order to provide a good vapour tight seal vertically up and down each corner of the structure, each of the right and left hand log ends 30 and 32 is formed with mating sealing surfaces. In the right hand log end 30, a vertical right angular rabbit 44 is formed extending down the inside face of the block 38 of the log end 30, having a depth equal to somewhat less than half the thickness of the log, and has a height and width equal to the height and length of the block 38. The recess 44, and notch 40, thus define a continuous vertical sealing surface 46, facing the end of log end 30. The adjacent inner side facing surface 48 of the log end 30 forms the other sealing surface, the two sealing surfaces 46 and 48 thus being located at right angles to one another and forming a projecting shoulder.

On the adjacent log end 32, a right angular rabbit 44*a*is formed, which extends somewhat further along the length of the log than the recess 44 of the log end 30. The recess 44*a* extends vertically across the full width of the log end 32, and over the full extent of the block 38*a*, and to a depth equal to somewhat less than half the thickness of the log. The mating surfaces on the log end 32, defined by the rabbit 44*a*, comprise two adjacent right angular surfaces namely end facing surface 50 and side facing surface 52 of recess 44*a* and thus together define a right angular vertical groove or recess for reception of the mating shoulder (ie. surfaces 46 and 48) of log end 30. The surface 46 of the log end 30 abutts against the surface 52 of the log end 32, and the surface 48 of the log end 30 abutts against the surface 50 of the log end 32. Such surfaces extend throughout the vertical height of each log 10, and thus provide continuous complementary mating surfaces in the corners to provide a good vapour tight seal.

Figure 9:
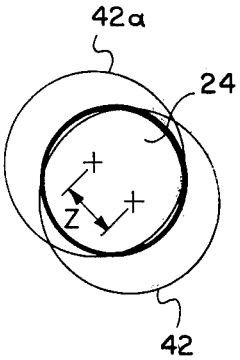
FIG. 9 is a schematic illustration showing the offsetting of the holes relative to the size of the metal rod, and, FIG. 10 is a top plan view corresponding to FIG. 8 showing an alternate embodiment.

In order to insure that the surfaces are drawn together under pressure, and therefore maintain their sealing engagement during use, the holes 42 and 42*a* are deliberately misaligned with one another as shown in FIG. 9.

In the embodiment of FIG. 8, such misalignment is procured by deliberately machining the recesses 44 and 44*a* to different tolerances so that, when they are fitted together, the holes 42 and 42*a* do not align perfectly with one another. Referring now to FIG. 8, it is assumed that the centers of the holes 42 and 42*a* are regarded as fixed reference points. The lateral distance X between the center of hole 42 and the face 48 is therefore arranged to be slightly greater than the longitudinal distance X'between the X' of hole 42*a* and face 50. This is done by machining the notch 44*a* in log end 32 slightly short.

Similarly, the longitudinal distance Y between the center of the hole 42, and the face 46 is slightly less than the lateral distance Y' between the center of the hole 42*a* and the fact 52. Again, this is done by machining the notch 44 in log end 30 slightly short. The effect of these two adjustments will thus cooperate to displace the one hole 42 relative to the other hole 42*a* slightly offset with respect to one another in the direction diagonal to the axis of both logs 10 as shown in FIG. 9. The total distance of displacement along the diagonal line Z of FIG. 9 is the product of the two differences between X and X' and Y and Y' referred to above. It will be seen that the thickness of the block portions 38 and 38*a* remains the same, and only the length of their respective notches 44 and 44*a* are adjusted so as to procure the offsetting of the centers of the holes 42 and 42*a* with respect to one another. In this way, by a very simple adjustment of cutting machinery it is possible to procure the diagonal misalignment of the holes 42 and 42*a* so as to achieve the results of the invention as noted below.

In operation, the two starter logs 12 are placed in spaced apart parallel relationship, with the metal tie rods 24 extending upwardly through the holes 42 and 42*a*. The underside of the corners of the starter logs 12 are recessed as at 54 so as to permit some form of fastening to be arranged on the lower end of the tie rods 24. However, conceivably the tie rods 24 could be made with some form of flush fitting fastening so that such a recessing would be unnecessary. It will of course be appreciated that the log ends 30*a* and 32*a* of the log 12 will be essentially similar to the log ends 30 and 32*a* described above with the exception of the notch or recess 40, the logs 12 being only half the height of the regular log 10 and therefore not having such a notch 40.

The other two starter logs 12*a* are then assembled and regular logs 10 are then assembled one after the other. The assembly of any one log 10 simply comprises raising it up to the full height of the tie rods 24, introducing the two tie rods 24 into the holes 42 and 42*a* at the two ends of the log 10, and allowing the log 10 to slide downward. This will be relatively easy since the holes 42 and 42*a* are somewhat oversized with regard to the tie rods 24. As the log 10 approaches its final position, the holes 42 and 42*a* will then bind on the tie rods 24. All that is required to bed the log down is to tap each end lightly with the hand or a mallet, and it will move snugly into position.

The same proceedure is then repeated for successive courses of logs 10 until the structure is almost completed, at which time the roof logs 16 can be inserted, and the final log and/or finishing logs 12 and 12*b* can be added, and the fastenings can be attached to the top end of the tie rods 24 and tightened up.

By the use of the invention, substantial diagonal pressure is developed along the diagonal offset line Z, forcing the complementary mating sealing surfaces 48 and 50, and 46 and 52 respectively into tight engagement with one another so as to provide a good vapour tight seal throughout the full height of each of the corners of the structure.

The interior of the sauna room or other structure can then be completed with any other interior fittings as desired.

By way of an example of the type of dimensions which will produce a satisfactory result, the 1¼ inch thick sauna logs as illustrated are formed with log ends 30 and 32 as shown in FIG. 8. Logs as long as seven feet may in fact be satisfactorily held together in this way. The holes 42 and 42*a* are drilled out to 5/16 of an inch, and the metal tie rod 24 is ¼ of an inch diameter steel rod. Each end of the metal rod 24 is threaded to receive standard nuts.

The dimensions of the notches 44 and 44*a* are selected so as to be slightly less than one half the thickness of the log, ie. about ¾ of 1 inch to ⅞ of 1 inch as shown in FIG. 8. The lateral distance X differs from the longitudinal distance X'by about 1/16 of an inch, and the longitudinal distance Y differs from the lateral distance Y' by about 1/16 of an inch.

The resulting diagonal displacement Z as shown in FIG. 9 is slightly greater than 1/16 of an inch, being essentially the longest side of a right angle triangle.

In order to ensure that there is no binding on any other surfaces of the log ends which would prevent the complementary mating surfaces from fitting tightly against one another, it is desirable that there should be a slight clearance shown as C between the side facing face 56 of the block 38, and the end facing face 58 of the lower part of the log end 32, defined by the notch 40*a*. Similarly, it is desirable that there should be a slight clearance between the side facing face 60 of block 38*a*, and the adjacent end facing face 62 of the log end 30 as defined by the notch 40.

In practice this clearance will be minimised, ie. about 1/32 inch. In the drawings the clearance is somewhat exaggerated for the sake of clarity.

As mentioned above, it is not necessary that either of the holes 42 and 42*a* be drilled centrally with respect to the block 38 and 38*a*. They could be drilled in any other location, the principal requirement being that when the complementary mating surfaces 46–52 and 48–50 are engaged, that the holes shall not align, and that the misalignment shall preferably be in a direction which is at approximately 45° to both logs, ie. along the line Z.

Where logs of a length greater than 7 feet are used, it is preferable to use an additional metal tie rod at about their mid-points. In this case of course the additional holes are aligned with one another.

As mentioned above, there are of course other ways of producing the offsetting of the holes 42 and 42*a*.

Figure 10:
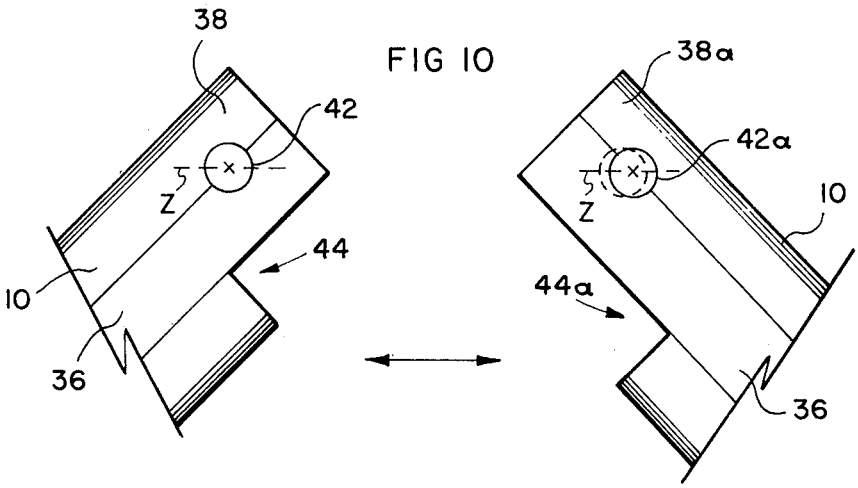

Thus as shown in FIG. 10, the mating surfaces 46–52 and 48–50 can be so arranged that the overlapping block portions 38 and 38*a*, would align perfectly with one another. Each of the recesses 44 and 44*a* will thus be machined to the same dimensions.

The offsetting of the holes in this case could simply be produced by drilling the one hole 42 centrally with respect to its block 38, and by deliberately drilling the other hole 42*a* diagonally off center on its block 38*a* as shown in FIG. 10. This will then produce the offsetting between the two holes as shown in phantom in FIG. 10.

The offsetting of the two holes could also be achieved by drilling both holes 42 and 42*a* off center in opposite directions by equal amounts.

It will also be seen that the complementary mating surfaces 46–52, and 48–50 in addition to providing a vapour tight seal, are responsible for maintaining each of the corners of the structure at a true right angle. It will of course be appreciated that the mating surfaces 46–52 and 48–50 do not necessarily themselves have to form a right angle. They could form a lesser or conceivably a greater angle. All that is required is that they should match so that when drawn tightly together they form a good seal, and also establish the corner of the structure at a right angle.

It will also be understood that the mating surfaces 46–52 and 48–50 will be vertical — i.e. normal to the axis of their respective logs. In this way the four walls of the structure will be located plumb, without any additional work or correction being required.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A log wall corner construction for use in the construction of corners in the walls of log cabin type structures and the like wherein the walls of such log cabin or the like structures are formed of tongued and grooved planks laid edge to edge, with end portions of said planks arranged in pairs in interlocking overlying relation, a said pair comprising;

a first end portion of a first said plank, said first end portion having an end face and inner and outer faces, and upper and lower edges;

notch means formed in said first end portion, extending from a said edge to about an intermediate point of said first plank and extending from said inner to said outer face thereof;

an interlocking block portion, defined by a portion of said end of said first plank adjacent said notch means;

a second end portion of a second said plank, having an end face and inner and outer faces, and upper and lower edges;

notch means formed in said second end portion extending from a said edge to an intermediate point thereof and extending from said inner face to said outer face dimensioned to receive said block portion of said first end portion;

an interlocking block portion defined by a portion of said end of said second plank adjacent said notch means;

two sealing surfaces formed on one said end portion, transversely of the longitudinal axis of said plank adjacent said notch means, one said sealing surface being directed substantially towards said end, and the other sealing surface being directed inwardly whereby to form a projecting shoulder;

two sealing surfaces formed on the other said end portion extending transversely of the longitudinal axis of said plank forming a complementary recess being dimensioned and oriented to receive said projecting shoulder on said one end portion, whereby when said two end portions are interlocked with one another with the block portion of one said end portion located within the notch means of the other said end portion , and said block portions overlapping and registering one above the other, said sealing surfaces interengage and abut with one another, and, fastening opening means in said block portions of both first and second end portions whereby fastening means may be interengaged between said overlapping block portions and operable to set up forces operating in a plane parallel to the axis of said planks diagonally across said corner whereby to draw said sealing surfaces into pressurized sealing engagement with said projecting shoulder fitting tightly into said complementary recess.

2. A log wall corner construction as claimed in claim 1 wherein said block portions on said first and second end portions define inner and outer surfaces, the outer surfaces of said block portions being coplanar with the outer faces of said end portions of said planks, and said inner surfaces lying in planes intermediate said inner and outer faces of said planks, and wherein said notch means in said first and second end portions define end surfaces lying in planes spaced from the planes of said end faces of said end portions of said plank by a distance less than the distance between said inner and outer faces of said planks, but sufficient to receive respective block portions therein.

3. A log wall corner construction as claimed in claim 1 wherein said fastening opening means in respective said block portions are slightly misaligned with one another, when said end portions are interengaged, with their block portions overlapping as aforesaid.

4. A log wall corner construction as claimed in claim 3 wherein said misalignment of said fastening opening means is procured by forming said sealing surfaces with predetermined dimensions such that said opening means cannot be brought into exact alignment.

5. A log wall corner construction as claimed in claim 4 wherein said misalignment of said fastening opening means is located along an axis extending through said corner, at an angle of substantially 45° of the axis of both said planks.

6. A log wall corner construction as claimed in claim 1 wherein said sealing surfaces on said first end portion form a transverse shoulder extending transversely of the axis of the plank and wherein said sealing surfaces on said second log end form a transverse recess extending transversely of the axis of said second plank, said shoulder being shaped and adapted to fit within said recess, when said first and second end portions ae interengaged.

* * * * *